US011325379B2

(12) United States Patent
Clark

(10) Patent No.: US 11,325,379 B2
(45) Date of Patent: May 10, 2022

(54) FLUID EJECTION DIES

(71) Applicant: Hewlett-Packard Development Company, L.P., Spring, TX (US)

(72) Inventor: Garrett E. Clark, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/965,689

(22) PCT Filed: Mar. 12, 2018

(86) PCT No.: PCT/US2018/022041
§ 371 (c)(1),
(2) Date: Jul. 29, 2020

(87) PCT Pub. No.: WO2019/177581
PCT Pub. Date: Sep. 19, 2019

(65) Prior Publication Data
US 2021/0039392 A1 Feb. 11, 2021

(51) Int. Cl.
*B41J 2/14* (2006.01)

(52) U.S. Cl.
CPC ..... *B41J 2/14201* (2013.01)

(58) Field of Classification Search
CPC ..... B41J 2/14201; B41J 2202/12; B41J 2002/14459; B41J 2002/14403; B41J 2/14145; B41J 2/1404; B41J 2/145
See application file for complete search history.

(56) References Cited

U.S. PATENT DOCUMENTS

| | | | |
|---|---|---|---|
| 5,790,149 | A | 8/1998 | Abe et al. |
| 8,474,951 | B2 | 7/2013 | Inoue et al. |
| 2006/0131264 | A1 | 6/2006 | Kawamura et al. |
| 2009/0096838 | A1 | 4/2009 | Chino et al. |
| 2009/0141063 | A1 | 6/2009 | Takano et al. |
| 2013/0063522 | A1 | 3/2013 | Arai et al. |
| 2015/0085018 | A1 | 3/2015 | Yamada et al. |
| 2015/0145929 | A1 | 5/2015 | Ikeda |
| 2015/0239241 | A1 | 8/2015 | Maher et al. |
| 2016/0176188 | A1 | 6/2016 | Mabuchi et al. |

FOREIGN PATENT DOCUMENTS

| | | | |
|---|---|---|---|
| JP | 2009-083445 | A | 4/2009 |
| JP | 2013-078933 | A | 5/2013 |
| JP | 2014-237323 | A | 12/2014 |
| JP | 2016-159514 | A | 9/2016 |
| JP | 2017-124615 | A | 7/2017 |

(Continued)

OTHER PUBLICATIONS ip.com search (Year: 2021).*

(Continued)

*Primary Examiner* — Lisa Solomon
(74) *Attorney, Agent, or Firm* — Fabian VanCott

(57) ABSTRACT

A fluid ejection die may include a number of fluid ejection chambers laid to correlate with a number of dividers formed in a fluid channel layer such that adjacent fluid ejection chambers are alternatively arranged on a relatively higher-temperature side of the fluid ejection die and a relatively lower-temperature side of the fluid ejection die.

20 Claims, 9 Drawing Sheets

(56) References Cited

FOREIGN PATENT DOCUMENTS

| | | | |
|---|---|---|---|
| JP | 2017-144571 | A | 8/2017 |
| JP | 2017-148998 | A | 8/2017 |
| JP | 2017-170835 | A | 9/2017 |
| JP | 2018-012291 | A | 1/2018 |
| WO | WO-2016137490 | | 9/2016 |

OTHER PUBLICATIONS

Lee, J-D et al., Two-dimensional nozzle arrangement in a monolithic inkjet printhead for high-resolution and high-speed printing, Dec. 5-8, 1999, http://ieeexplore.ieee.org/docu.

* cited by examiner

FLUID EJECTION DIES

BACKGROUND

Fluidic dies are any fluid flow structure or die that moves fluid through a number of channels within its various layers of material. One type of fluidic die is a fluid ejection die that ejects fluid from the die in order to precisely target the ejected fluid onto a substrate such as when printing an image on a print medium. A fluid ejection die in a fluid cartridge or print bar may include a plurality of fluid ejection elements on a surface of a silicon substrate. By activating the fluid ejection elements, fluids may be printed on substrates. The fluid ejection die may include an array of resistive or piezoelectric elements used to cause fluid to be ejected from the fluid ejection die. The fluids are caused to flow to the fluid ejection elements through slots and channels that are fluidically coupled to chambers in which the fluid ejection elements reside.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1A:
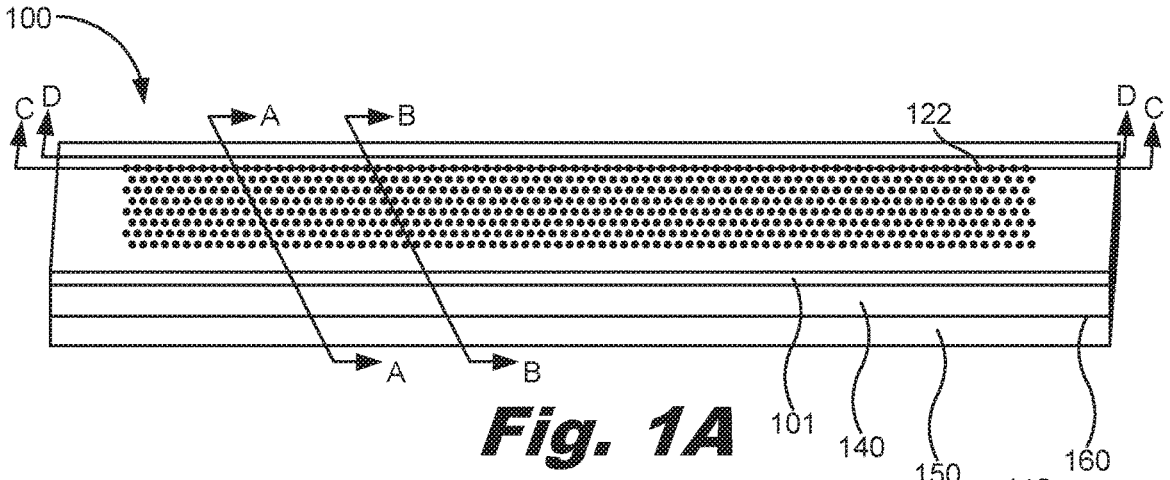
FIG. 1A is a perspective view of a fluidic die, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

Because many fluidic dies utilize thermal resistive actuators to move or eject fluid throughout and from the fluidic die, respectively, heat within the fluidic die may build up and cause the fluids to eject from the die in unexpected ways and cause a heat gradient to become present along the dimensions of the fluidic die. This heat gradient may be present along two axis of the fluidic die. For example, the temperature of the fluidic die may increase across the fluid die as well as the along a length of the fluidic die.

In some fluidic dies, a number of channels may be formed on the back side of the fluidic die behind a number of fluid ejection chambers and nozzles to reduce pressure losses within the fluidic die, and to assist in cooling the fluidic die by circulating cool fluid past the thermal resistive actuators. The channels also serve to assist in the stirring of particle-containing fluids such as pigmented inks to reduce or eliminate any particle settling that may occur in the fluid. Although the circulation of fluid in fluid channels assists in the cooling of the fluidic die, and stirring of particle-containing fluids, a heat gradient may still exist. Further, some nozzle layouts associated with the channels may form sawtooth thermal gradients along the swath of the fluidic die. In these examples, the nozzles may be arranged such that the sawtooth thermal gradients are perceptible on a printed media in the form of print quality defects when the fluid is ejected from the fluidic die. Areas of the printed media may include areas where more fluid was printed on the media, and areas where less fluid was printed on the media resulting in inconsistent coloring on the media.

Further, the heat gradient may cause fluid that is ejected from a relatively cooler side of the fluidic die to have different aerodynamic properties as it is ejected from the fluidic die onto print media as compared to fluid that is ejected from a relatively hotter side of the fluidic die. The different aerodynamics experienced by these droplets of differently heated fluid may also create visible inconsistencies in the printed media.

Examples described herein provide a fluid ejection die. The fluid ejection die may include a fluid ejection layer. The fluid ejection layer may include a number of fluid ejection actuators disposed in a number of fluid ejection chambers, and a number of nozzles fluidically coupled to the fluid ejection chambers. The fluid ejection die may also include a fluid channel layer defining a number of fluid channels therein. The fluid channels may be fluidically coupled to the fluid ejection chambers via a number of fluid feed holes defined within the fluid ejection layer. The fluid ejection die may also include a fluid slot layer disposed on a side of the fluid channel layer opposite the fluid ejection layer, and a first fluid slot and a second fluid slot defined in the fluid slot layer. The fluid ejection chambers are laid out such that adjacent fluid ejection chambers are alternatively arranged on a relatively higher-temperature side of the fluid ejection die and a relatively lower-temperature side of the fluid ejection die.

In one example, the fluid ejection die, during operation, may include a temperature gradient along at least two axis of the fluid ejection die. In this example, the fluid ejection chambers may be laid out such that adjacent fluid ejection chambers are alternatively arranged on a relatively higher-temperature side of the fluid ejection die and a relatively lower-temperature side of the fluid ejection die along the temperature gradient The layout of the fluid ejection chambers may include a nozzle density that results in a number of printed drops of fluid with an optical resolution higher than that of a human eye. Further, the nozzle density may be between 1,200 dots per inch (dpi) and 3,600 dpi.

The fluid ejection chambers may be arranged in a v-shape across a width of the fluid ejection die, and a number of dividers may be formed in a v-shape to correlate with the v-shaped arrangement of the fluid ejection chambers. The fluid ejection chambers may be arranged in a v-shape across a width of the fluid ejection die, and the dividers may include a number of pillars formed in a v-shape to correlate with the v-shaped arrangement of the fluid ejection chambers. The first fluid slot and the second fluid slot may be defined in the fluid slot layer along a length of the fluid ejection die.

Examples described herein provide a system for circulating fluid within a fluid ejection die. The system may include a fluid reservoir, and a fluid ejection die fluidically coupled to the fluid reservoir where the fluid ejection die includes a number of fluid ejection chambers laid out between a number of dividers formed in a fluid channel layer such that adjacent fluid ejection chambers are alternatively arranged on relatively higher-temperature side of the fluid ejection die and relatively lower-temperature side of the fluid ejection die.

The system may include a fluid ejection layer. The fluid ejection layer may include a number of fluid ejection actuators disposed in the fluid ejection chambers, and a number of nozzles fluidically coupled to the fluid ejection chambers. The fluid channel layer defines a number of fluid channels therein. The fluid channels are fluidically coupled to the fluid ejection chambers via a number of fluid feed holes defined within the fluid ejection layer. The system may also include a fluid slot layer disposed on a side of the fluid channel layer opposite the fluid ejection layer. The fluid slot layer may include a first fluid slot and a second fluid slot defined in the fluid slot layer.

The layout of the fluid ejection chambers includes a nozzle density that results in a number of printed drops of fluid with an optical resolution higher than that of a human eye. The fluid ejection chambers may be arranged in a v-shape across a width of the fluid ejection die. The dividers may include a number of ribs formed in a v-shape around the v-shaped arrangement of the fluid ejection chambers. The fluid ejection chambers may be arranged in a v-shape across a width of the fluid ejection die and the dividers may include a number of pillars formed in a v-shape around the v-shaped arrangement of the fluid ejection chambers.

Examples described herein provide a fluid ejection die. The fluid ejection die may include a number of fluid ejection chambers laid to correlate with a number of dividers formed in a fluid channel layer such that adjacent fluid ejection chambers are alternatively arranged on a relatively higher-temperature side of the fluid ejection die and a relatively lower-temperature side of the fluid ejection die. The fluid ejection die may include a fluid ejection layer. The fluid ejection layer may include a number of fluid ejection actuators disposed in the fluid ejection chambers, and a number of nozzles fluidically coupled to the fluid ejection chambers. The fluid channel layer defines a number of fluid channels therein. The fluid channels are fluidically coupled to the fluid ejection chambers via a number of fluid feed holes defined within the fluid ejection layer, and a fluid slot layer may be disposed on a side of the fluid channel layer opposite the fluid ejection layer. The fluid slot layer defines a first fluid slot and a second fluid slot.

The fluid ejection chambers may be arranged in a v-shape across a width of the fluid ejection die where the dividers include a number of ribs formed in a v-shape to correlate with the v-shaped arrangement of the fluid ejection chambers. The fluid ejection chambers may be arranged in a v-shape across a width of the fluid ejection die where the dividers include a number of pillars formed in a v-shape to correlate with the v-shaped arrangement of the fluid ejection chambers.

Turning now to the figures, FIG. 1A is a perspective view of a fluidic die, according to an example of the principles described herein. FIGS. 1B through 1E are cutaway views of the fluidic die (100) of FIG. 1A along line A-A, B-B, C-C, and D-D, respectively, as depicted in FIG. 1A, according to an example of the principles described herein. The fluidic die (100) of FIGS. 1A through 1E include elements that are common among the examples described herein.

The fluidic die (100) may include a fluid channel layer (140). The fluid channel layer (140) may include a number of fluid channels (104) formed in the channel layer (140) to allow for fluid to travel along a width of the fluidic die (100). The fluid channels (104) defined in the fluid channel layer (140) form a number of dividers such as ribs or posts between the fluid channels (104). These ribs or posts formed from the fluid channels (104) may be continuous or discontinuous along their length.

A fluid slot layer (150) may be disposed on a side of the fluid channel layer (140) opposite a fluid ejection layer (101). The slot layer (150) includes at least two slots (151, 152) formed therein. The slots (151, 152) include a first fluid slot (151) and a second fluid slot (152) defined in the slot layer (150) along a length of the fluidic die (100) and on opposite sides of the fluidic die (100) relative to the width of the fluidic die (100). The slots (151, 152) are fluidically coupled to the fluid channels (104) through the slot layer (150) and the channel layer (140) such that fluid that enters from the bottom of the fluidic die (100) as depicted by the arrows depicted in the fluid slots (151, 152) enter fluidic die through the first fluid slot (151) and exit the fluidic die (100) through the second fluid slot (152).

In this manner, the fluid enters the fluidic die (100) through the first fluid slot (151), travels through a number of channels (104) defined in the channel layer (140), enters the second fluid slot (152), and returns to a fluid source, for example. Some of the fluid that enters the fluid die (100) is ejected from the fluid ejection layer (101), but the movement of the fluid through the fluid slots (151, 152) and the fluid channels (104) ensures that no viscous plugs form along the path of the fluid travel including within the fluid slots (151, 152), the fluid channels (104), and fluid feed holes (108), fluid ejection chambers (110), and nozzle apertures (112) of the fluid ejection layer (101). Further, the flow of fluid through the fluid slots (151, 152) and the fluid channels (104) acts as a cooling system to cool actuators disposed within the fluidic die (100) including fluid ejection actuators (114) that eject fluid from the fluidic die (100) through the fluid ejection layer (101), and non-ejecting actuators that move fluid through passages, channels, and other pathways within the fluidic die (100).

In the examples described herein, fluid from, for example, a fluid reservoir (FIG. 8, 850) may be fluidically coupled to the slots (151, 152) to loop fluid into and out of the fluidic die (100). Further, in one example, a heat exchanger (FIG. 8, 851) may be included in or fluidically coupled to the fluid reservoir (850) to dissipate heat from the fluid after it has been moved through the fluidic die (100) and gathered heat. A filter (FIG. 8, 852) may also be included in or fluidically coupled to the fluid reservoir (850) to filter any impurities from the fluid. Because the fluid channels (104) are formed in the fluid channel layer (140), more heat may be collected by the fluid, recirculated through the fluidic die (100), and dissipated through the use of the heat exchanger (FIG. 8, 851) and fluid reservoir (850).

At least one of the fluid channels (104) fluidically couples the first fluid slot (151) to the second fluid slot (152). As is described in more detail herein, the fluid channels (104) may be formed at a diagonal across the width of the fluidic die (100), as v-shaped channels across the width of the fluidic die (100), as a zig-zag shape across the width of the fluidic die (100), or as a number of posts in any arrangement across the width of the fluidic die (100). However, the fluid channels (104) may be formed at any angle, pattern, or architecture across the width of the fluidic die (100) in order to fluidically couple the first fluid slot (151) to the second fluid slot (152).

In one example, the fluidic die (100) may also include a silicon-on-insulator (SOI) layer (160). The SOI layer (160) may be used in an SOI etching process during manufacturing to form the fluid slots (151, 152) and fluid channels (104) in the fluidic die (100). The SOI layer (160) may be made of, for example, silicon oxide. Further, in examples where a fluid feed hole substrate (118) is included, an additional SOI layer deposited between the fluid feed hole substrate (118) and the fluid channel layer (140) may be used to etch the fluid slots (151, 152) up to the SOI layer between the fluid feed hole substrate (118) and the fluid channel layer (140), and then removed using a wet etch process.

Figure 1B:
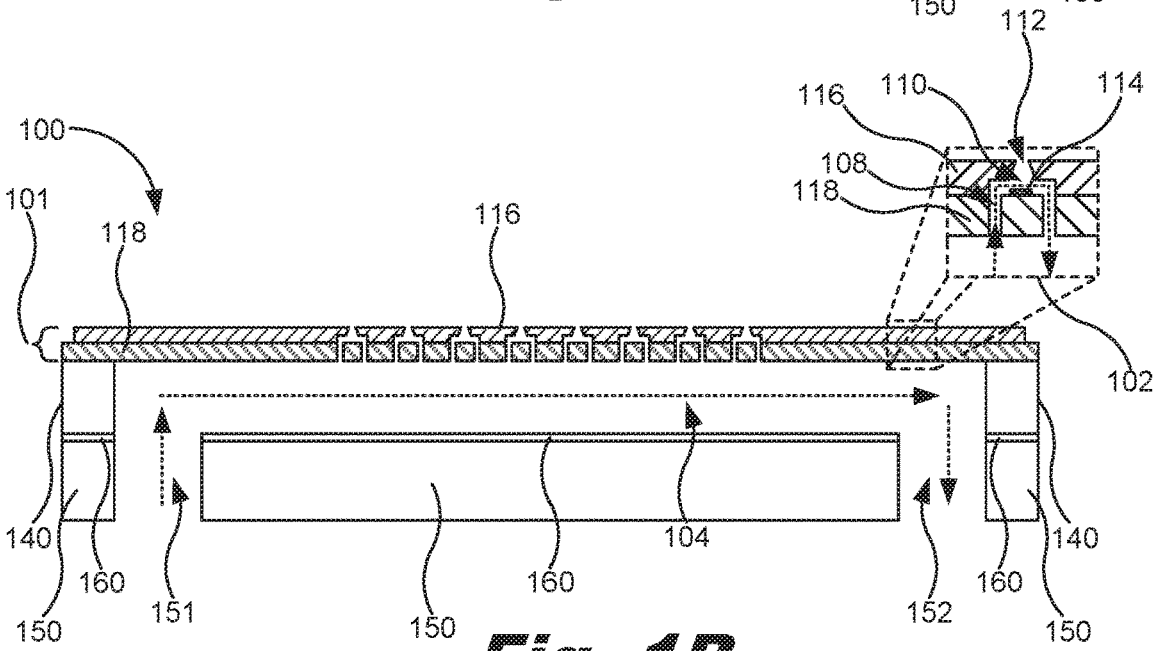
FIG. 1B is a cutaway view of the fluidic die of FIG. 1A along line A-A as depicted in FIG. 1A, according to an example of the principles described herein.
Figure 1C:
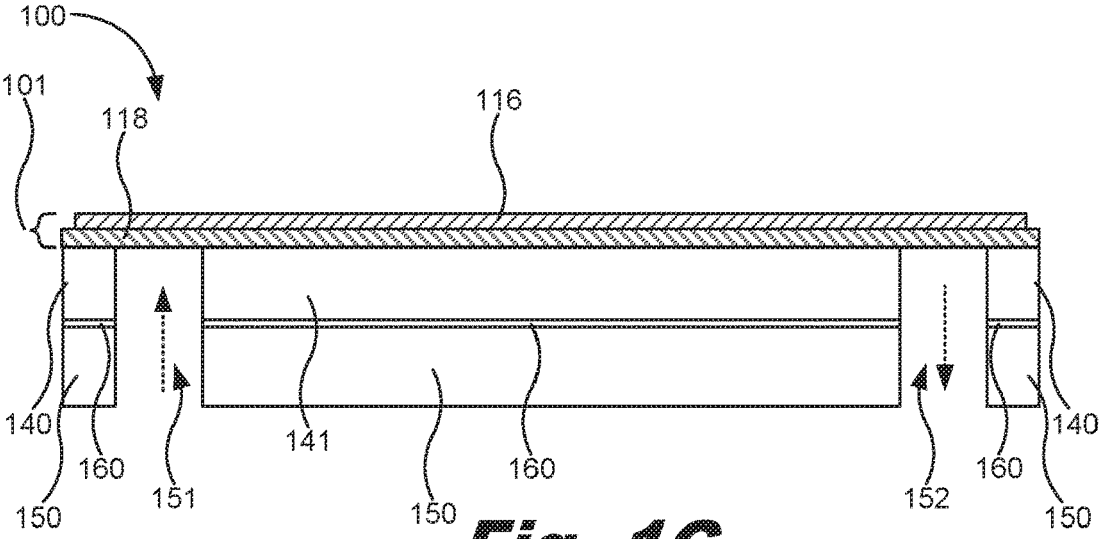
FIG. 1C is a cutaway view of the fluidic die of FIG. 1A along line B-B as depicted in FIG. 1A, according to an example of the principles described herein.

As depicted in FIGS. 1B and 1C, one of a number of fluid ejection subassemblies (102) may be formed in the fluid ejection layer (101). To eject the fluid onto a substrate such as a printing medium, the fluidic die (100) includes an array of fluid ejection subassemblies (102). For simplicity in FIG. 1A, one fluid ejection subassembly (102), and, in particular, its nozzle aperture (122), has been indicated with a reference number in FIG. 1A. Moreover, it should be noted that the relative size of the fluid ejection subassemblies (102) and the fluidic die (100) are not to scale, with the fluid ejection subassemblies (102) being enlarged for purposes of illustration. The fluid ejection subassemblies (102) of the fluidic die (100) may be arranged in columns or arrays such that properly sequenced ejection of fluid from the fluid ejection subassemblies (102) causes characters, symbols, and/or other graphics or images to be printed on the print medium as the fluidic die (100) and print medium are moved relative to each other.

The arrangement or layout of the fluid ejection subassemblies (102) includes a nozzle density that results in a number of ejected drops of fluid with an optical resolution higher than that of a human eye. In this example, the nozzle density may produce printed images that are close enough so that a user cannot discern between ejected drops of fluid form one another. In one example, the nozzle density may be between 1,200 dots per inch (dpi) and 3,600 dpi. Further, the fluid ejection subassemblies (102) of the fluidic die (100) may be arranged such that adjacent fluid ejection chambers are alternatively arranged on a relatively higher-temperature side of the fluid ejection die and a relatively lower-temperature side of the fluid ejection die down the swath of the fluidic die (100).

In one example, the fluid ejection subassemblies (102) in the array may be further grouped. For example, a first subset of fluid ejection subassemblies (102) of the array may pertain to one color of ink, or one type of fluid with a set of fluidic properties, while a second subset of fluid ejection subassemblies (102) of the array may pertain to another color of ink, or fluid with a different set of fluidic properties. The fluidic die (100) may be coupled to a controller that controls the fluidic die (100) in ejecting fluid from the fluid ejection subassemblies (102). For example, the controller defines a pattern of ejected fluid drops that form characters, symbols, and/or other graphics or images on the print medium. The pattern of ejected fluid drops is determined by the print job commands and/or command parameters received from a computing device. Further, the controller defines an order in which the fluid is ejected from the fluid ejection subassemblies (102), and, as described herein, causes alternatively arranged fluid ejection subassemblies (102) located on a relatively higher-temperature side of the fluid ejection die (100) and a relatively lower-temperature side of the fluid ejection die (100) down the swath of the fluidic die (100) to be activated to reduce or eliminate any sawtooth thermal gradients that are otherwise perceptible on a printed media in the form of print quality defects when the fluid is ejected from the fluidic die (100).

To eject fluid, the fluid ejection subassembly (102) includes a number of components. For example, a fluid ejection subassembly (102) may include an ejection chamber (110) to hold an amount of fluid to be ejected, a nozzle aperture (112) through which an amount of the fluid is ejected, and a fluid ejection actuator (114), disposed within the ejection chamber (110), to eject the amount of fluid through the nozzle aperture (112). The ejection chamber (110) and nozzle aperture (112) may be defined in the fluid ejection layer (101) that may be deposited on top of a fluid feed hole substrate (118) of the fluid ejection layer (101) or that is disposed directly on top of the fluid channel layer (140) in examples that do not include a fluid feed hole substrate (118). In some examples, the nozzle substrate (116) may be formed of SU-8 or other material.

Turning to the fluid ejection actuators (114), the fluid ejection actuator (114) may include a firing resistor or other thermal device, a piezoelectric element, or other mechanism for ejecting fluid from the ejection chamber (110). For example, the fluid ejection actuator (114) may be a firing resistor. The firing resistor heats up in response to an applied voltage. As the firing resistor heats up, a portion of the fluid in the ejection chamber (110) vaporizes to form a steam bubble. This steam bubble pushes fluid out the nozzle aperture (112) and onto the print medium. As the cooling steam bubble collapses, fluid is drawn into the ejection chamber (110) from a fluid feed hole (108), and the process repeats. In this example, the fluidic die (100) may be a thermal inkjet (TIJ) fluidic die (100).

In another example, the fluid ejection actuator (114) may be a piezoelectric device. As a voltage is applied, the piezoelectric device changes shape which generates a pressure pulse in the ejection chamber (110) and pushes the fluid out the nozzle aperture (112) and onto the print medium. In this example, the fluidic die (100) may be a piezoelectric inkjet (PIJ) fluidic die (100).

Figure 1D:
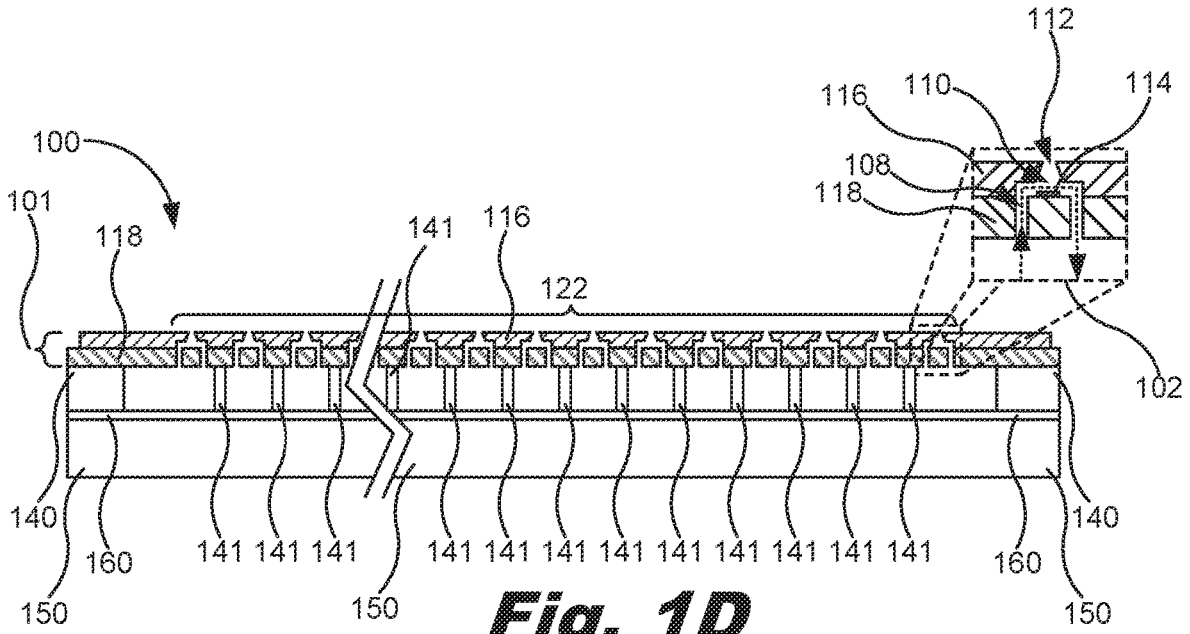
FIG. 1D is a cutaway view of the fluidic die of FIG. 1A along line C-C as depicted in FIG. 1A, according to an example of the principles described herein.
Figure 1E:
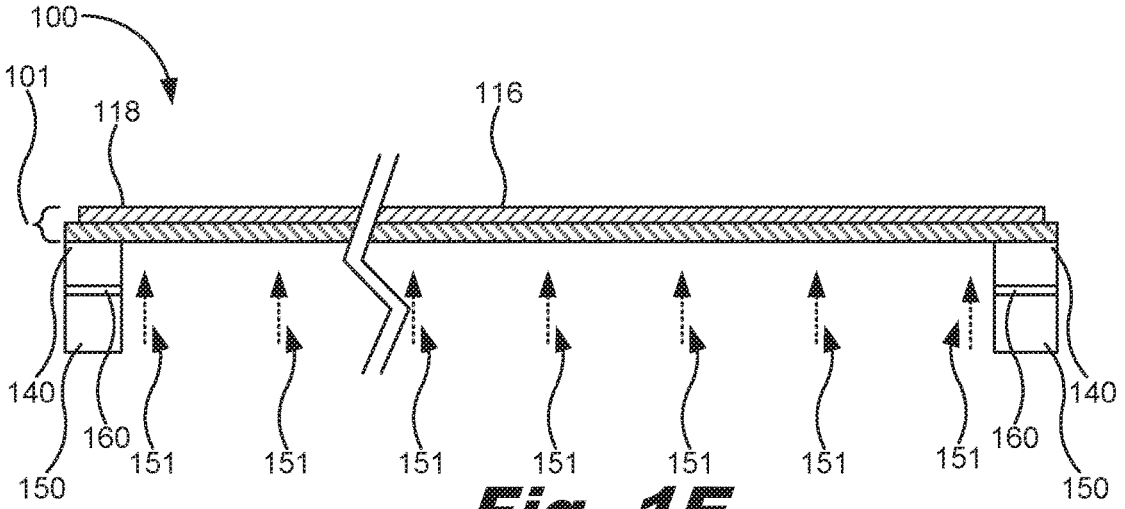
FIG. 1E is a cutaway view of the fluidic die of FIG. 1A along line D-D as depicted in FIG. 1A, according to an example of the principles described herein.

The fluidic die (100) also includes a number of fluid feed holes (108) that are formed in a fluid feed hole substrate (118). The fluid feed holes (108) deliver fluid to and from the corresponding ejection chamber (110). In some examples, the fluid feed holes (108) are formed in a perforated membrane of the fluid feed hole substrate (118). For example, the fluid feed hole substrate (118) may be formed of silicon, and the fluid feed holes (108) may be formed in a perforated silicon membrane that forms part of the fluid feed hole substrate (118). That is, the membrane may be perforated with holes which, when joined with the nozzle substrate (116), align with the ejection chamber (110) to form paths of ingress and egress of fluid during the ejection process. As depicted in FIGS. 1B and 1D, two fluid feed holes (108) may correspond to each ejection chamber (110) such that one fluid feed hole (108) of the pair is an inlet to the ejection chamber (110) and the other fluid feed hole (108) is an outlet from the ejection chamber (110) as indicated by the arrows depicted in the projected window of these figures. In some examples, the fluid feed hole (108) may be round holes, square holes with rounded corners, or other type of passages. In examples where a fluid feed hole substrate (118) is included, an additional SOI layer deposited between the fluid feed hole substrate (118) and the fluid channel layer (140) may be used to etch the fluid slots (151, 152) up to the SOI layer between the fluid feed hole substrate (118) and the fluid channel layer (140), and then removed using a wet etch process.

Further, in one example, the fluidic die (100) may not include a fluid feed hole substrate (118). In this example, the fluid ejection actuators (114) are disposed on the fluid channel layer (140), and the nozzle substrate (116) is disposed directly on top of the fluid channel layer (140). Further in this example, the ejection chambers (110) and nozzle apertures (112) are aligned with the fluid ejection actuators (114). Thus, in this example, the fluid does not flow through fluid feed holes (108) before arriving at the ejection chambers (110), but flows directly over the fluid ejection actuators (114) as it travels through the number of fluid channels (104).

The fluidic die (100) may also include a number of fluid channels (104) defined in the fluid channel layer (140). The fluid channels (104) are defined within the fluid channel layer (140) along a width of the fluid ejection device. The fluid channels (104) may be formed to fluidically interface with the backside of the fluid feed hole substrate (118) or directly with the fluid ejection chambers (110), and deliver fluid to and from the fluid feed holes (108) defined within the fluid feed hole substrate (118) or the fluid ejection chambers (110), respectively. In one example, each fluid channel (104) is fluidically coupled to a number of fluid feed holes (108) of an array of fluid feed holes (108) or an array of fluid ejection chambers (110). That is, fluid enters a fluid channel (104), passes through the fluid channels (104), passes to respective fluid feed holes (108) or directly through the fluid ejection chambers (110), and then exits the fluid feed holes (108) or fluid ejection chambers (110), and into the fluid channel (104) to be mixed with other fluid in the associated fluidic delivery system. In another example, the fluid may be drawn into a first fluid channel (104), and moved into an adjacent fluid channel (104). Examples of this movement of fluid between fluid channels (104) is described herein in connection with, of example, FIG. 6.

In some examples, the fluid path through the fluid channels (104) is perpendicular to the flow through the fluid feed holes (108) in examples including the fluid feed hole substrate (118). That is, fluid enters the first fluid slot (151), passes through the fluid channel (104), passes to respective fluid feed holes (108), and then exits the second fluid slot (152) to be mixed with other fluid in the associated fluidic delivery system. In examples where the fluid feed hole substrate (118) is not included, the fluid enters the first fluid slot (151), passes through the fluid channel (104), passes to respective fluid ejection chambers (110), exits the fluid ejection chambers (110), and then exits the second fluid slot (152) to be mixed with other fluid in the associated fluidic delivery system.

The fluid channels (104) are defined by any number of surfaces. For example, one surface of a fluid channel (104) may be defined by the membrane portion of the fluid feed hole substrate (118) in which the fluid feed holes (108) are defined in examples including the fluid feed hole substrate (118). In another example, one surface of the fluid channels (104) may be defined by the nozzle substrate (116) in which the ejection chambers (110) and nozzle apertures (112) are defined in examples that do not include the fluid feed hole substrate (118). Another surface may be at least partially defined by the fluid channel layer (140).

The individual fluid channels (104) of the array may correspond to fluid feed holes (108) and/or corresponding ejection chambers (110) of a particular row. For example, as depicted in FIG. 1A, the array of fluid ejection subassemblies (102) may be arranged in rows, and each fluid channel (104) may align with a row, such that fluid ejection subassemblies (102) in a row may share the same fluid channel (104). While FIG. 1A depicts the rows of fluid ejection subassemblies (102) in a straight, diagonal line, the rows of fluid ejection subassemblies (102) may be angled, curved, chevron-shaped, v-shaped, staggered, zig-zagged, or otherwise oriented or arranged. Accordingly, in these examples, the fluid channels (104) may be similarly, angled, curved, chevron-shaped, v-shaped, staggered, zig-zagged, or otherwise oriented or arranged to align with the arrangement of the fluid ejection subassemblies (102). In another example, the fluid feed holes (108) of a particular row may correspond to multiple fluid channels (104). That is, the rows may be straight, but the fluid channels (104) may be angled. While specific reference is made to a fluid channel (104) per two rows of fluid ejection subassemblies (102), more or fewer rows of fluid ejection subassemblies (102) may correspond to a single fluid channel (104).

Further, as depicted in FIGS. 1B, 1C, and 1D, a plurality of fluid channels (104) may be separated by dividers such as ribs or posts (141). The ribs or posts (141) may serve to support the layers above the fluid channel layer (140) including the nozzle substrate (116) and fluid feed hole substrate (118) (in examples including the fluid feed hole substrate (118) of the fluid ejection layer (101)). In one example, the ribs or posts (141) extend between adjacent fluid channels (104) for the length of the fluid channels (104). In another example, the ribs or posts (141) may be intermittent along the length or width of the fluid channels (104). Further, the ribs or posts may include continuous or discontinuous structures along the length of these structures formed between the fluid channels (104). In the case of discontinuous structures such as posts, the fluid may be free to move in the fluid channel layer (140) around the posts.

In some examples, the fluid channels (104) deliver fluid to rows of different subsets of the array of fluid feed holes (108). For example, as depicted in FIGS. 1A and 1B, a plurality of fluid channels (104) may deliver fluid to a row of fluid ejection subassemblies (102) in a first subset and a row of fluid ejection subassemblies (102) in a second subset. In this example, one type of fluid, for example, one ink of a first color, may be provided to a first subset via its corresponding fluid channels (104) and an ink of a second color may be provided to a second subset via its corresponding fluid channels (104). In a specific example, a monochrome fluidic die (100) may implement at least one fluid channel (104) across multiple subsets of fluid ejection subassemblies (102). Such fluidic dies (100) may be used in multi-color printing fluid cartridges.

These fluid channels (104) promote increased fluid flow through the fluidic die (100). For example, without the fluid channels (104), fluid passing on a backside of the fluidic die (100) may not pass close enough to the fluid feed holes (108) and/or the ejection chambers (110) to sufficiently mix with fluid passing through the fluid ejection subassemblies (102). However, the fluid channels (104) draw fluid closer to the fluid ejection subassemblies (102) thus facilitating greater fluid mixing. The increased fluid flow also improves nozzle health as used fluid is removed from the fluid ejection subassemblies (102), which used fluid, if allowed to remain in the fluid ejection subassembly (102), can damage the fluid ejection subassembly (102).

Further, as cooler fluid is moved through the fluid channels (104), into the fluid feed holes (108) and/or the ejection chambers (110), and back into the fluid channels (104), the cool fluid causes the fluid ejection actuator (114) to cool by pulling the heat from the fluid ejection actuator (114) through heat transfer. Thus, the fluid to be ejected by the fluid ejection subassemblies (102) serves also as a coolant to cool the fluid ejection actuators (114) within the fluidic die (100) and, in turn, cool the fluidic die (100) as a whole.

However, as the fluid passes over a first fluid ejection actuator (114) along a length or width of the fluidic die (100), the fluid is relatively hotter than when it was introduced to the first fluid ejection actuator (114). The fluid gets hotter and hotter as it is passed over consecutive fluid ejection actuators (114). This causes the coolant effect of the fluid to become less and less effective as it moves down the rows of fluid ejection actuators (114) from one end of the fluidic die (100) to the other, and causes a heat gradient to be created along the length and width of the fluidic die (100) with a first side of the fluidic die (100) where the fluid is first introduced to the fluid channels (104) being relatively cooler than a second side of the fluidic die (100) where the fluid leaves the fluid channels (104) and with a first side of the fluidic die (100) where the fluid is first introduced being relatively cooler than the second side. In order to reduce or eliminate any print quality defects that may arise from ejecting relatively cooler and relatively hotter fluid from the fluid ejection subassemblies (102), the fluid ejection chambers (110) of the fluid ejection subassemblies (102) may be laid out such that adjacent fluid ejection chambers (110) are alternatively arranged on a relatively higher-temperature side of the fluid ejection die and a relatively lower-temperature side of the fluid ejection die, and the effects of these differently heated fluid ejection subassemblies (102) may be concealed and rendered imperceptible and undetectable by the human eye.

Given that the fluid slots (151, 152) run the length of the fluidic die (100) and the fluid channels (104) within the fluid channel layer (140) run across the width of the fluidic die (100), the fluid slots (151, 152) serve to provide fresh, cool fluid to the fluid channels (104) and the fluid ejection layer (101) such that any temperature gradient that may otherwise exist along the length or width of the fluidic die (100) may be reduced. In one example, a number of external pumps may be fluidically coupled to the fluid slots (151, 152). The external pumps cause fluid to flow into and out of the fluid slots (151, 152) as well as into and out of the fluidically coupled fluid channels (104). With cool fluid constantly flowing into the fluid channels (104), and the fluid feed holes (108) and/or ejection chambers (110) of the fluid ejection subassemblies (102), fresh cool fluid is made available to the fluid ejection layer (101). Further, by pulling fluid heated by the fluid ejection actuators (114) and any non-ejection actuators of the fluid ejection subassemblies (102) out from the fluid ejection layer (101) and the fluid channels (104), heat is continually removed from the system, and any heat gradients are not formed with as high of a degree along the fluidic die (100).

In one example, while the figures depict straight fluid channels (104), in some examples, the sidewalls may include uneven or non-linear sidewalls such as zig-zag sidewalls. Further posts, or other structures may be included to create turbulent flow in the microchannel and encourage the coupling of recirculation of fluid through the fluid feed holes (108) and/or fluid ejection chambers (110) to recirculation of fluid through the fluid channels (104) and fluid slots (151, 152).

In one example, a number of internal pumps may be used to move the fluid through the recirculation channels including the fluid feed hole (108) and/or the ejection chambers (110) as well as the relatively larger recirculation channels such as the fluid channels (104) and fluid slots (151, 152). These internal pumps may take the form of a recirculation pump, which is an example of a non-ejecting actuator that moves fluid through passages, channels, and other pathways within the fluidic die (100). The recirculation pumps may be any resistive device, piezoelectric device, or other microfluidic pump device.

Figure 2:
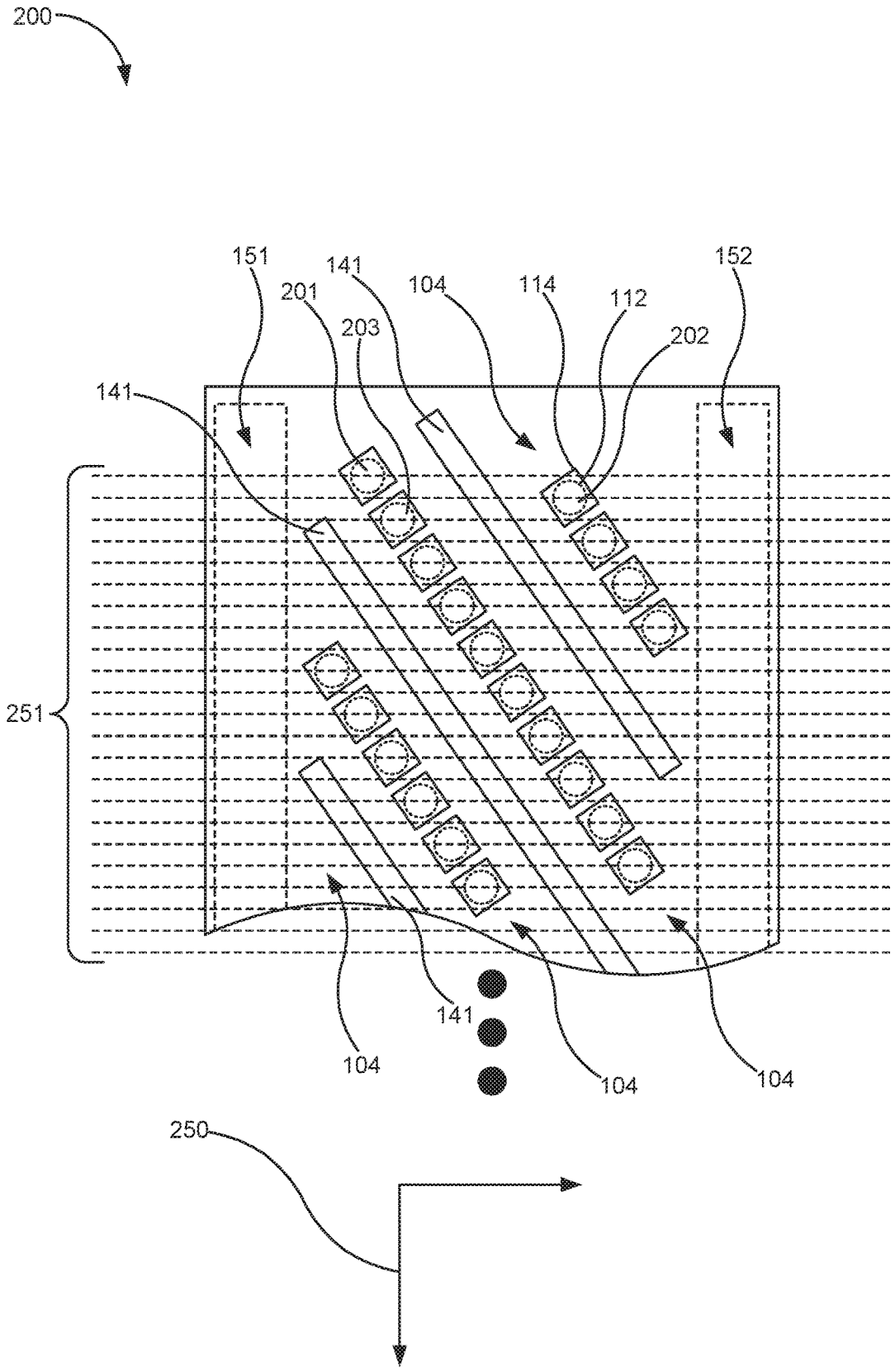
FIG. 2 is a block diagram of a portion of the fluidic die depicting an arrangement of fluid actuators and nozzles with a number of fluid channels, according to an example of the principles described herein.
Figure 3:
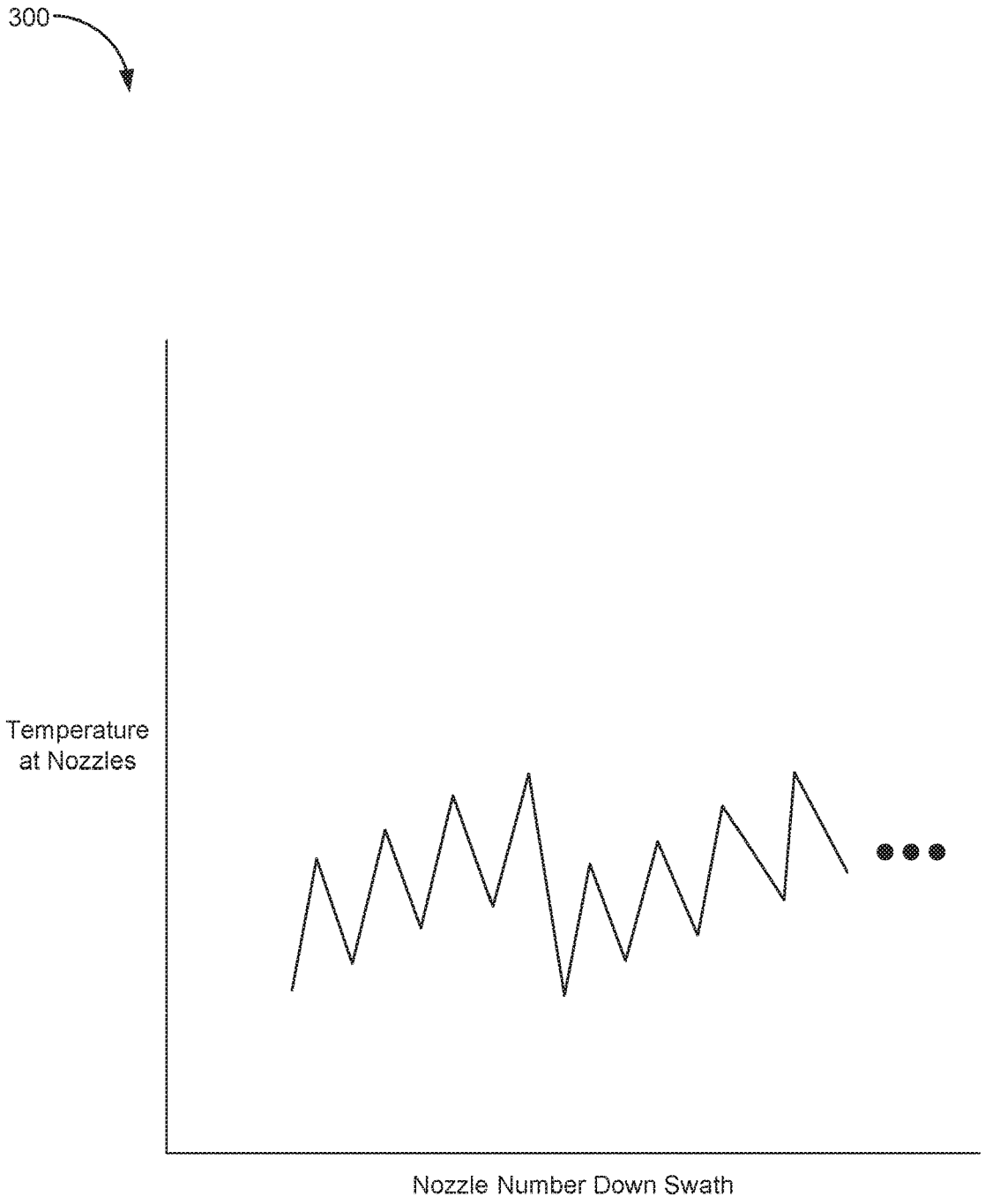
FIG. 3 is a graph depicting a temperature of nozzles within the fluidic die down a swath of nozzles within the fluidic die of the example of FIG. 2, according to an example of the principles described herein.

FIG. 2 is a block diagram of a portion of the fluidic die (200) depicting an arrangement of fluid ejection actuators (114) and nozzle apertures (112) with a number of fluid channels (104), according to an example of the principles described herein. FIG. 3 is a graph (300) depicting a temperature of fluid ejection subassemblies (102) within the fluidic die (200) down a swath of fluid ejection subassemblies (102) within the fluidic die (200) of the example of FIG. 2, according to an example of the principles described herein. Elements within FIGS. 2 and 3 that are similarly number with respect to FIGS. 1A through 1E indicate similar elements whose description is provided in connection with FIGS. 1A through 1E herein. Further, the ellipses depicted at the bottom of FIG. 2 indicates that the length of the fluidic die (200) may be as long as desired, and that the arrangement of the fluid ejection subassemblies (102) described herein may continue down the length of the fluidic die (200). Further, the ellipses depicted to the right of the graph (300) of FIG. 3 relatively indicates that the number of fluid ejection subassemblies (102) whose temperature is analyzed may be plotted as the length of the fluidic die (200) increases.

The fluid ejection actuators (114) and nozzle apertures (112) of the fluid ejection subassemblies (102) are depicted in FIG. 2 for simplicity in the figures, and the fluid ejection actuators (114) and nozzle apertures (112) indicate the locations of the fluid ejection subassemblies (102) throughout the fluidic die (200). A number of dividers (141) separate the fluid channels (104) from one another. Further, the first fluid slot (151) is fluidically coupled to the fluid channels (104) and a fluid source, and allows the fluid to enter the fluidic die (200). The second fluid slot (152) moves the fluid from the fluidic channels (104) back to the fluid source.

The fluid ejection actuators (114) and nozzle apertures (112) of the fluid ejection subassemblies (102) are arranged such that adjacent fluid ejection subassemblies (102) are alternatively arranged on a relatively higher-temperature side of the fluid ejection die and a relatively lower-temperature side of the fluid ejection die. The fluid that flows through the fluid channels (104) cools the fluidic die (200) to a degree, but a temperature gradient may still persist along the width and length of the fluidic die (200) where the temperature increases in the direction of arrows (250). In this manner, the fluidic die (200), during operation, includes a temperature gradient along at least two axis of the fluid ejection die as defined by the arrows (250). The fluid ejection subassemblies (102) may be laid out such that adjacent fluid ejection chambers are alternatively arranged on a relatively higher-temperature side of the fluid ejection die and a relatively lower-temperature side of the fluid ejection die along the temperature gradient. Thus, as described herein, this temperature gradient may cause a sawtooth thermal gradient across the fluidic die (200) in which defects are perceptible on a printed media when the fluid is ejected from the fluidic die (100). Thus, to reduce or eliminate these possible print defects, the fluid ejection subassemblies (102) are alternatively arranged on a relatively higher-temperature side of the fluid ejection die and a relatively lower-temperature side of the fluid ejection die.

The dashed lines (251) indicate the location of adjacent fluid ejection subassemblies (102) as they are located down a length of the fluidic die (200). For example, the left-top most fluid ejection subassembly (201) is located on an opposite side as the next fluid ejection subassembly (202). The first fluid ejection subassembly (201) will be relatively cooler than the second fluid ejection subassembly (202) in the column since these two fluid ejection subassemblies (102) are located across the width of the fluidic die (200) from one another, and because the second fluid ejection subassembly (202) is located in a relatively hotter portion of the thermal gradient of the fluidic die (200).

The third fluid ejection subassembly (203) may be located on an opposite side of the fluidic die (200) and in a relatively cooler portion of the fluidic die (200) relative to the second fluid ejection subassembly (202). In this manner, subsequent fluid ejection subassemblies (102) along a column of fluid ejection subassemblies (102) may be located on alternatively cooler and relatively hotter portions of the fluidic die (200). This assists in concealing and rendering imperceptible any print defects such that the print defects are undetectable by the human eye.

As indicated by the graph (300) of FIG. 3, the temperature at each fluid ejection subassembly (102) may be plotted as a function of the number of the fluid ejection subassembly (102) down the swath or column of the fluidic die (200). Rather than obtaining a plot that indicates an ever-increasing, stepped temperature of the fluid ejection subassemblies (102) as the temperature is detected along the column or swath of fluid ejection subassemblies (102), the arrangement provided by the fluidic die (200) of FIG. 2 reduces the stepped plot by integrating or interspersing relatively cooler fluid ejection subassemblies (102) with relatively hotter fluid ejection subassemblies (102). This reduces perceptible print quality defects that may otherwise be humanly detectable on printed media that does not utilize the arrangement of fluid ejection subassemblies (102) described herein.

Figure 4:
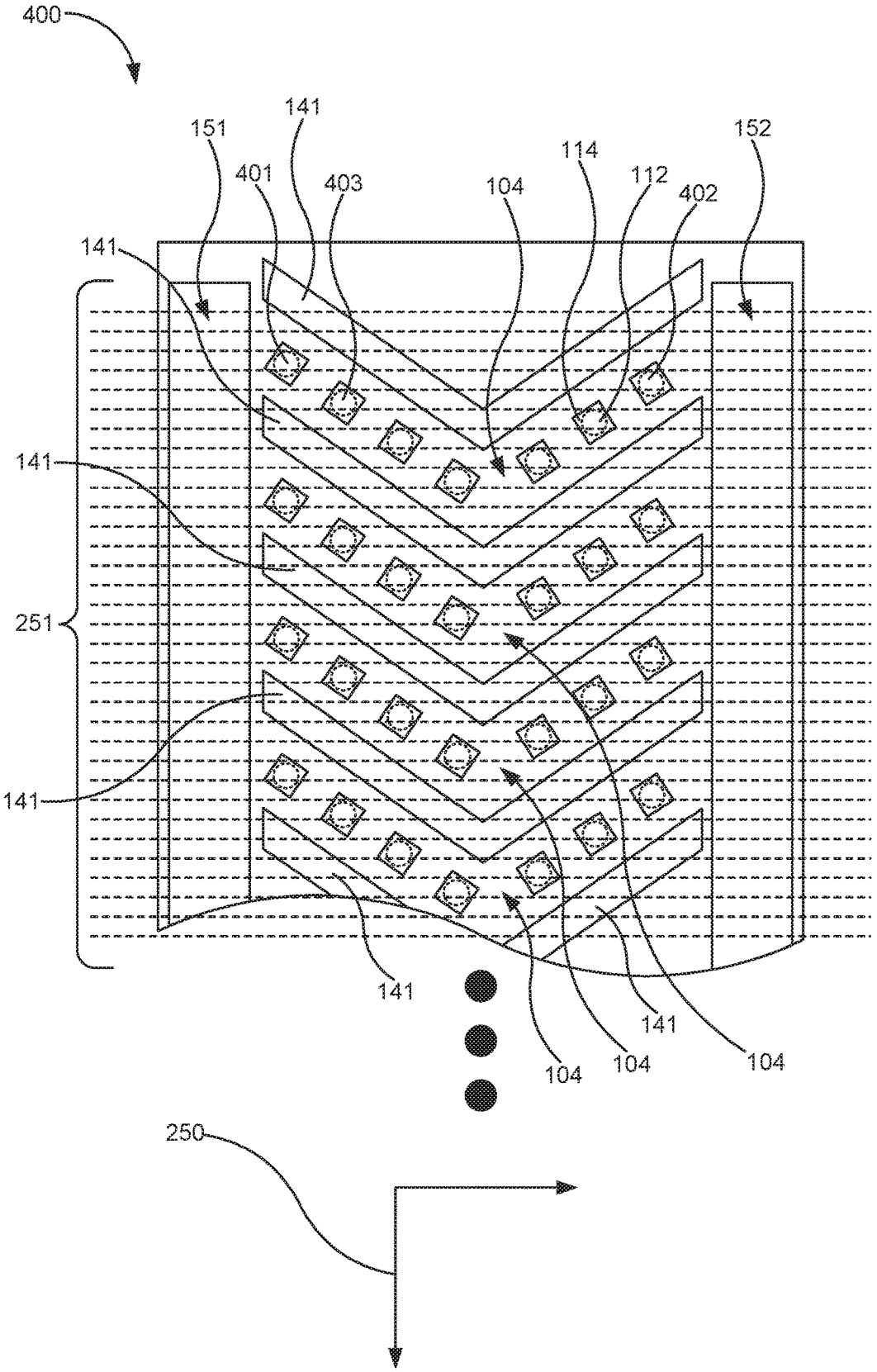
FIG. 4 is a block diagram of a portion of the fluidic die depicting an arrangement of fluid actuators and nozzles with a number of fluid channels, according to another example of the principles described herein.
Figure 5:
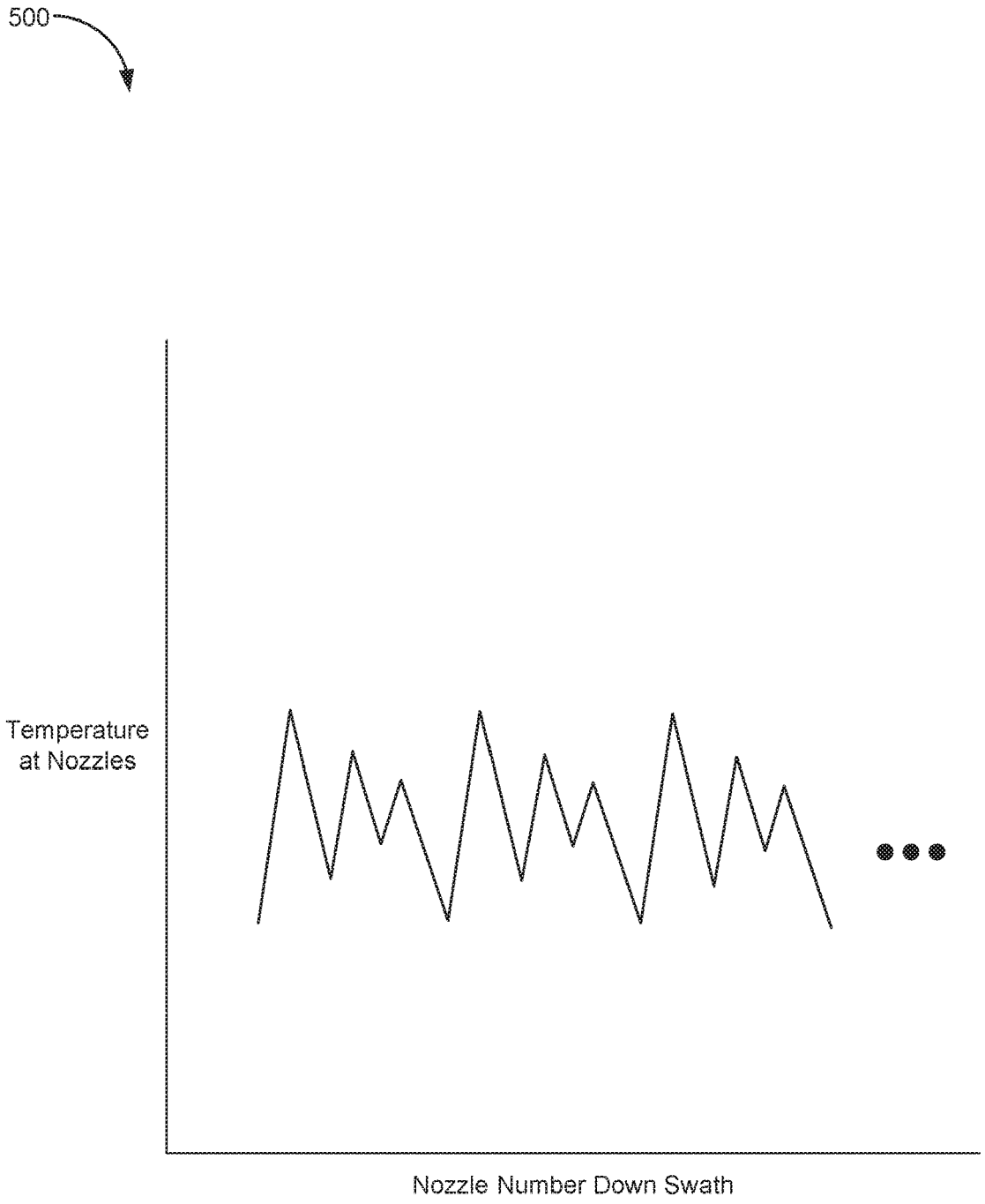
FIG. 5 is a graph depicting a temperature of nozzles within the fluidic die down a swath of nozzles within the fluidic die of the example of FIG. 4, according to an example of the principles described herein.

FIG. 4 is a block diagram of a portion of the fluidic die (400) depicting an arrangement of fluid ejection actuators (114) and nozzle apertures (112) with a number of fluid channels (104), according to another example of the principles described herein. FIG. 5 is a graph (500) depicting a temperature of fluid ejection subassemblies (102) within the fluidic die (400) down a swath of nozzle apertures (112) within the fluidic die (400) of the example of FIG. 4, according to an example of the principles described herein. Elements within FIGS. 4 and 5 that are similarly number with respect to FIGS. 1A through 3 indicate similar elements whose description is provided in connection with FIGS. 1A through 3 herein. Further, the ellipses depicted at the bottom of FIG. 4 indicates that the length of the fluidic die (400) may be as long as desired, and that the arrangement of the fluid ejection subassemblies (102) described herein may continue down the length of the fluidic die (400). Further, the ellipses depicted to the right of the graph (500) of FIG. 5 relatively indicates that the number of fluid ejection subassemblies (102) whose temperature is analyzed may be plotted as the length of the fluidic die (400) increases.

Again, the fluid ejection actuators (114) and nozzle apertures (112) of the fluid ejection subassemblies (102) are depicted in FIG. 4 for simplicity in the figures, and the fluid ejection actuators (114) and nozzle apertures (112) indicate the locations of the fluid ejection subassemblies (102) throughout the fluidic die (400). A number of dividers (141) separate the fluid channels (104) from one another, and, in the example of FIG. 4 have a v shape or chevron shape. The v-shaped dividers (141) support the fluid ejection layer (101) without interfering with the fluid feed holes (108). Further, the first fluid slot (151) is fluidically coupled to the fluid channels (104) and a fluid source, and allows the fluid to enter the fluidic die (400). The second fluid slot (152) moves the fluid from the fluidic channels (104) back to the fluid source.

The fluid ejection actuators (114) and nozzle apertures (112) of the fluid ejection subassemblies (102) are arranged such that adjacent fluid ejection subassemblies (102) are alternatively arranged on a relatively higher-temperature side of the fluid ejection die and a relatively lower-temperature side of the fluidic die (400) as described herein in connection with FIG. 2. In the example of FIG. 4, the fluid ejection subassemblies (102) are arranged to match the form of the v-shaped dividers (141) such that the fluid ejection subassemblies (102) follow a v-shaped path. Again, the fluid that flows through the fluid channels (104) cools the fluidic die (400) to a degree, but a temperature gradient may still persist along the width and length of the fluidic die (400) where the temperature increases in the direction of arrows (250).

Thus, to reduce or eliminate possible print defects, the fluid ejection subassemblies (102) are alternatively arranged on a relatively higher-temperature side of the fluid ejection die and a relatively lower-temperature side of the fluid ejection die. The dashed lines (251) in FIG. 4 indicate the location of adjacent fluid ejection subassemblies (102) as they are located down a length of the fluidic die (400). For example, the left-top most fluid ejection subassembly (401) is located on an opposite side as the next fluid ejection subassembly (402), and in the case of the example of FIG. 4, the first fluid ejection subassembly (401) is a left-most fluid ejection subassembly (102) and the second fluid ejection subassembly (402) is a right-most fluid ejection subassembly (102) on the fluidic die (400). The first fluid ejection subassembly (401) will be relatively cooler than the second fluid ejection subassembly (402) in the column since these two fluid ejection subassemblies (102) are located across the width of the fluidic die (400) from one another, and because the second fluid ejection subassembly (402) is located in a relatively hotter portion of the thermal gradient of the fluidic die (400).

The third fluid ejection subassembly (403) may be located on an opposite side of the fluidic die (400) and in a relatively cooler portion of the fluidic die (400) relative to the second fluid ejection subassembly (402). In this manner, subsequent fluid ejection subassemblies (102) along a column of fluid ejection subassemblies (102) may be located on alternatively cooler and relatively hotter portions of the fluidic die (400). This assists in concealing and rendering imperceptible any print defects such that the print defects are undetectable by the human eye.

As indicated by the graph (500) of FIG. 5, the temperature at each fluid ejection subassembly (102) may be plotted as a function of the number of the fluid ejection subassembly (102) down the swath or column of the fluidic die (400) as in FIG. 3. In the example of FIGS. 4 and 5, the arrangement provided by the fluidic die (400) of FIG. 4 reduces the stepped plot by integrating or interspersing relatively cooler fluid ejection subassemblies (102) with relatively hotter fluid ejection subassemblies (102) to an even greater degree than the examples of FIGS. 2 and 3. This further reduces perceptible print quality defects that may otherwise be humanly detectable on printed media that does not utilize the arrangement of fluid ejection subassemblies (102) described herein.

Figure 6:
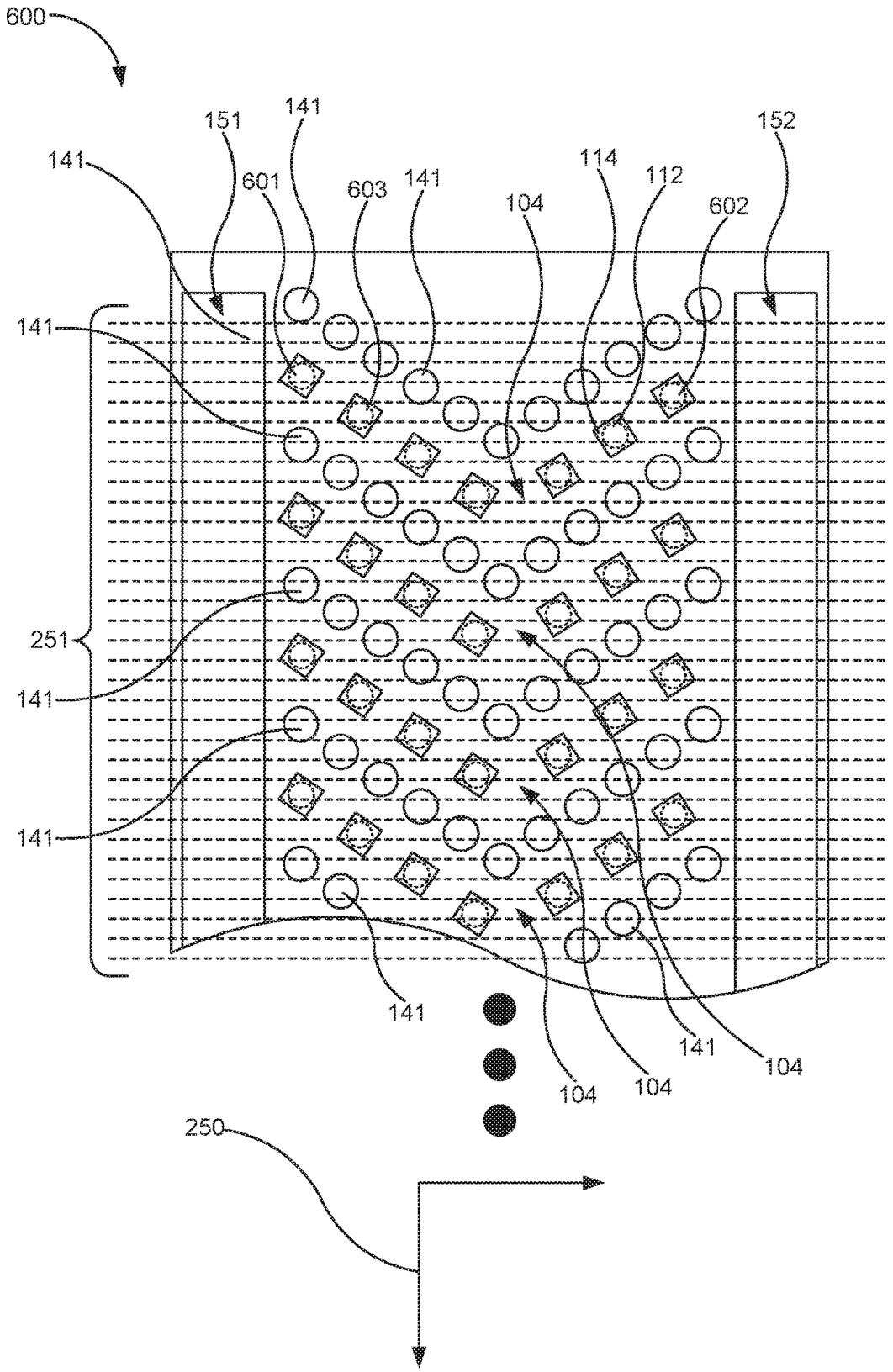
FIG. 6 is a block diagram of a portion of the fluidic die depicting an arrangement of fluid actuators and nozzles with a number of fluid channels, according to another example of the principles described herein.
Figure 7:
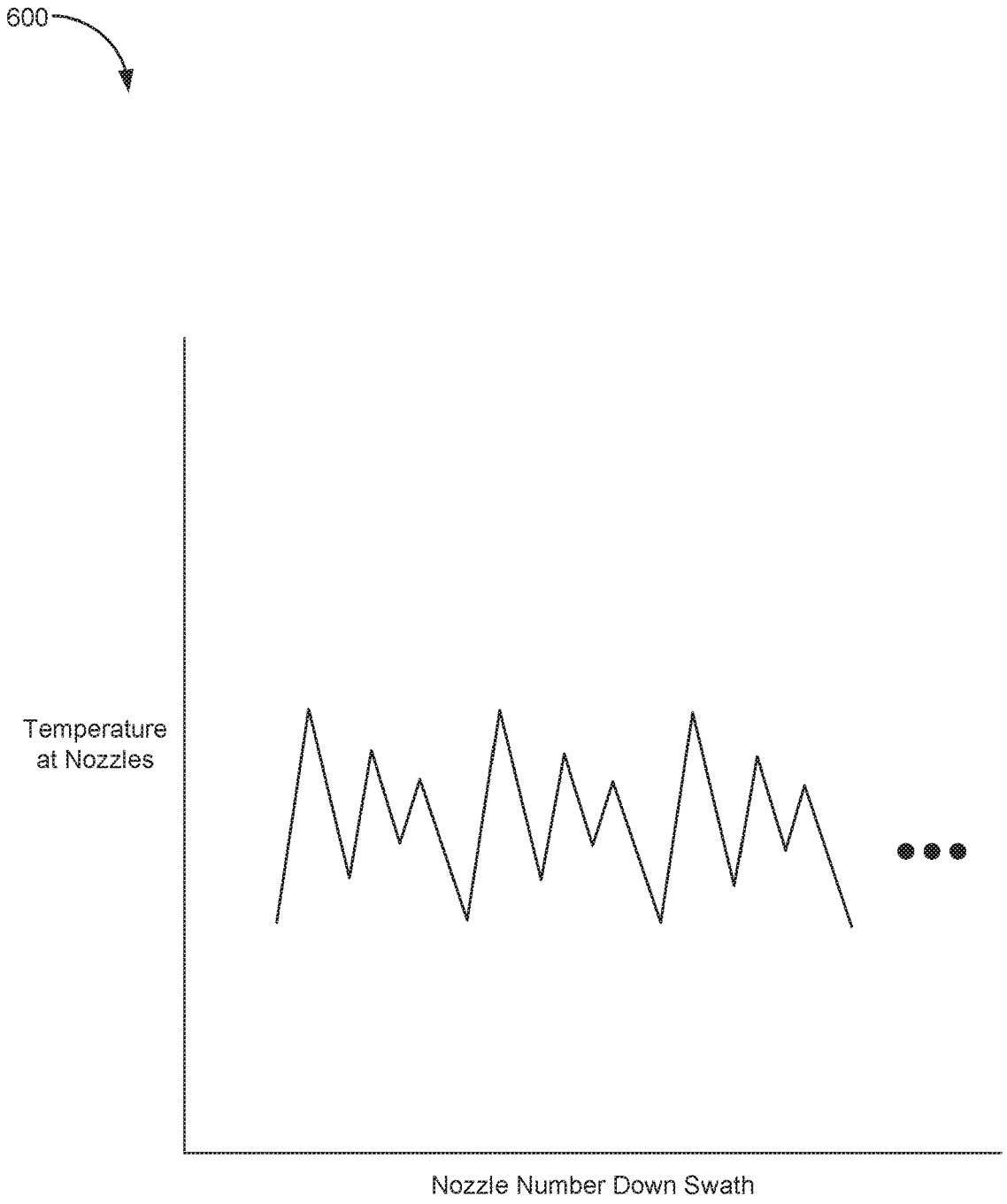
FIG. 7 is a graph depicting a temperature of nozzles within the fluidic die down a swath of nozzles within the fluidic die of the example of FIG. 6, according to an example of the principles described herein.

FIG. 6 is a block diagram of a portion of the fluidic die (600) depicting an arrangement of fluid ejection actuators (114) and nozzle apertures (112) with a number of fluid channels (104), according to another example of the principles described herein. FIG. 7 is a graph (700) depicting a temperature of fluid ejection subassemblies (102) within the fluidic die (600) down a swath of fluid ejection subassemblies (102) within the fluidic die (600) of the example of FIG. 6, according to an example of the principles described herein. The fluidic die (600) of FIG. 6 includes a number of pillars (141) as dividers between the channels (104). In this example, the pillars (141) may be arranged in a v-shaped line, and the fluid ejection subassemblies (102) may also be arranged in a v-shaped line. The pillars (141) of FIG. 6 support the fluid ejection layer (101) without interfering with the fluid feed holes (108). In another example, the pillars (141) may be arranged in a straight or diagonal line across the width of the fluid die (600). In another example, the pillars (141) may be arranged non-linearly or randomly across the width of the fluid die (600).

The fluid within the fluidic die (600) is able to move from the first fluid slot (151) through the fluid channels (104), between the pillars (141) and into the second fluid slot (152). In doing so, the fluid may move past the fluid ejection subassemblies (102). Further, a similarly described in connection with the examples of FIGS. 2 through 5, the fluid ejection actuators (114) and nozzle apertures (112) of the fluid ejection subassemblies (102) are arranged such that adjacent fluid ejection subassemblies (102) are alternatively arranged on a relatively higher-temperature side of the fluid ejection die and a relatively lower-temperature side of the fluidic die (400) as described herein in connection with FIGS. 2 and 4. Again, in the example of FIG. 6, to reduce or eliminate possible print defects, the fluid ejection subassemblies (102) are alternatively arranged on a relatively higher-temperature side of the fluid ejection die and a relatively lower-temperature side of the fluid ejection die. The dashed lines (251) in FIG. 6 indicate the location of adjacent fluid ejection subassemblies (102) as they are located down a length of the fluidic die (600). For example, the left-top most fluid ejection subassembly (601) is located on an opposite side as the next fluid ejection subassembly (602), and in the case of the example of FIG. 6, the first fluid ejection subassembly (601) is a left-most fluid ejection subassembly (102) and the second fluid ejection subassembly (602) is a right-most fluid ejection subassembly (102) on the fluidic die (600). The first fluid ejection subassembly (601) will be relatively cooler than the second fluid ejection subassembly (602) in the column since these two fluid ejection subassemblies (102) are located across the width of the fluidic die (600) from one another, and because the second fluid ejection subassembly (602) is located in a relatively hotter portion of the thermal gradient of the fluidic die (600).

The third fluid ejection subassembly (603) may be located on an opposite side of the fluidic die (600) and in a relatively cooler portion of the fluidic die (600) relative to the second fluid ejection subassembly (602). In this manner, subsequent fluid ejection subassemblies (102) along a column of fluid ejection subassemblies (102) may be located on alternatively cooler and relatively hotter portions of the fluidic die (600). This assists in concealing and rendering imperceptible any print defects such that the print defects are undetectable by the human eye.

As indicated by the graph (700) of FIG. 7, the temperature at each fluid ejection subassembly (102) may be plotted as a function of the number of the fluid ejection subassembly (102) down the swath or column of the fluidic die (600) as in FIGS. 3 and 5. In the example of FIGS. 6 and 7, the arrangement provided by the fluidic die (600) of FIG. 6 reduces the stepped plot by integrating or interspersing relatively cooler fluid ejection subassemblies (102) with relatively hotter fluid ejection subassemblies (102) to an even greater degree than the examples of FIGS. 2 and 3. This further reduces perceptible print quality defects that may otherwise be humanly detectable on printed media that does not utilize the arrangement of fluid ejection subassemblies (102) described herein.

The architectures of the dividers (104) in FIGS. 2, 4, and 6 are given as examples. Other architectures may also be included such as, for example, zig-zag architectures, other pillar arrangements, other angles of dividers other than those depicted in FIG. 2, among other architectures.

Figure 8:
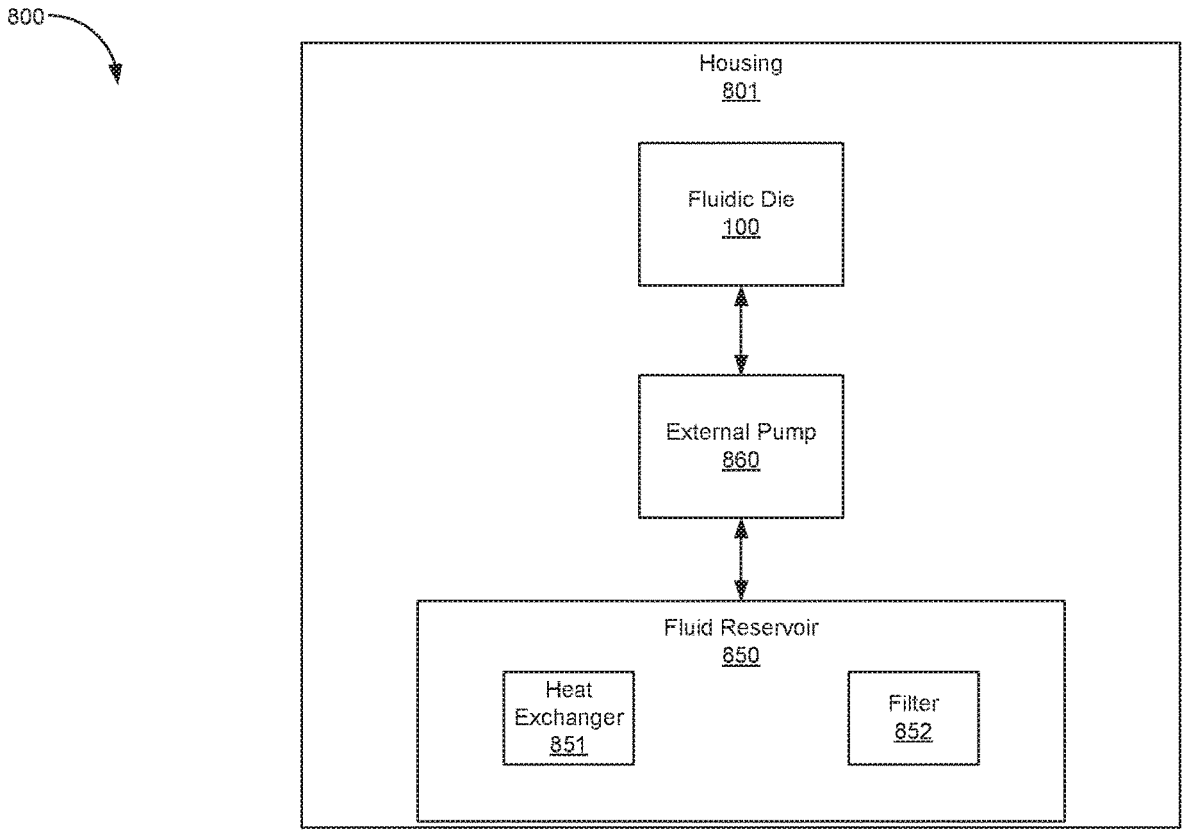
FIG. 8 is a block diagram of a printing fluid cartridge including the fluidic die of FIGS. 1A through 2, 4 and 6, according to an example of the principles described herein.

FIG. 8 is a block diagram of a printing fluid cartridge (800) including the fluidic die (100, 200, 400, 600, collectively referred to herein as 100) of FIGS. 1A through 2, 4 and 6, according to an example of the principles described herein. The printing fluid cartridge (800) may be any system for recirculating fluid with the fluid ejection die (100), and may include a housing (801) to house at least one fluid ejection die (100). The housing (801) may also house a fluid reservoir (850) fluidically coupled to the fluid ejection die (100), and provides fluid to the fluid ejection die (100).

A number of external pumps (860) may be located inside and/or outside the housing (801). The external pump (860), coupled to the fluid reservoir (850), serves to pump fluid into and out of the fluid ejection die (100) as the fluid moves into and out of the fluid channels (104) by exerting a pressure difference sufficient to move the fluid through the fluid channels (104). The fluid reservoir (850) may also include a heat exchanger (851) to dissipate heat from the fluid as it returns back to the fluid reservoir (851) from the fluidic die (100). The heat exchanger (851) may be any device that removes heat from the fluid, and may include, for example, a heat sink, a Peltier device, an air conditioning system, a fan, other heat exchanging devices or systems, or combinations thereof. In one example, the fluid reservoir (850) may also include a filter (852) to filter any impurities from the fluid.

In the examples described herein, a number of sensors may be placed within or adjacent to a number of the fluid flow passages within the fluidic die (100). Some examples of sensors that may be disposed within the fluid flow passages may include, for example, thermal sense resistors, strain gauge sensors, and flow sensors, among other types of sensors.

The specification and figures describe a fluid ejection die. The fluid ejection die may include a number of fluid ejection chambers laid to correlate with a number of dividers formed in a fluid channel layer such that adjacent fluid ejection chambers are alternatively arranged on a relatively higher-temperature side of the fluid ejection die and a relatively lower-temperature side of the fluid ejection die. The fluidic die provides, without any active control, a device and system for passively addressing thermal variation within a fluidic die without any additional logic circuitry or heat to be added to the fluidic die.

The preceding description has been presented to illustrate and describe examples of the principles described. This description is not intended to be exhaustive or to limit these principles to any precise form disclosed. Many modifications and variations are possible in light of the above teaching.

What is claimed is:

1. A fluid ejection die comprising:

a fluid ejection layer comprising:

a number of fluid ejection actuators disposed in a number of fluid ejection chambers; and a number of nozzles fluidically coupled to the fluid ejection chambers;

a fluid channel layer defining a number of fluid channels therein, the fluid channels being fluidically coupled to the fluid ejection chambers via a number of fluid feed holes defined within the fluid ejection layer;

a fluid slot layer disposed on a side of the fluid channel layer opposite the fluid ejection layer; and a first fluid slot and a second fluid slot defined in the fluid slot layer, wherein across a width of the fluid ejection die, one side is a relatively higher-temperature side during operation and the opposite side is a relatively lower-temperature side;

wherein the fluid ejection chambers are laid out such that adjacent fluid ejection chambers along a length of the fluid ejection die are alternatively arranged on the relatively higher-temperature side of the fluid ejection die and the relatively lower-temperature side of the fluid ejection die.

2. The fluid ejection die of claim 1, wherein the layout of the fluid ejection chambers comprises a nozzle pitch that results in a number of printed drops of fluid with an optical resolution higher than that discernable by a human eye.

3. The fluid ejection die of claim 2, wherein the nozzle pitch comprises between 1,200 dots per inch (dpi) and 3,600 dpi.

4. The fluid ejection die of claim 1, wherein the fluid ejection chambers are arranged in a v-shape across a width of the fluid ejection die.

5. The fluid ejection die of claim 1, wherein the fluid ejection chambers are arranged in a v-shape across a width of the fluid ejection die, and wherein dividers between adjacent v-shapes of fluid ejection chambers comprise a number of pillars.

6. The fluid ejection die of claim 1, wherein the first fluid slot and the second fluid slot are defined in the fluid slot layer along a length of the fluid ejection die.

7. A system for circulating fluid within a fluid ejection die, comprising:

a fluid reservoir;

fluid ejection die fluidically coupled to the fluid reservoir, the fluid ejection die comprising a number of fluid ejection chambers laid out between a number of dividers formed in a fluid channel layer such that adjacent fluid ejection chambers are alternatively arranged on relatively higher-temperature side of the fluid ejection die and relatively lower-temperature side of the fluid ejection die; and wherein the fluid ejection chambers are arranged in a v-shape across a width of the fluid ejection die.

8. The system of claim 7, comprising:

a fluid ejection layer comprising:

a number of fluid ejection actuators disposed in the fluid ejection chambers; and a number of nozzles fluidically coupled to the fluid ejection chambers;

wherein the fluid channel layer defines a number of fluid channels therein, the fluid channels being fluidically coupled to the fluid ejection chambers via a number of fluid feed holes defined within the fluid ejection layer;

a fluid slot layer disposed on a side of the fluid channel layer opposite the fluid ejection layer, the fluid slot layer a first fluid slot and a second fluid slot defined in the fluid slot layer.

9. The system of claim 7, wherein the layout of the fluid ejection chambers comprises a nozzle pitch that results in a number of printed drops of fluid with an optical resolution higher than that discernable by a human eye.

10. The system of claim 7, wherein the dividers comprise a number of ribs formed in a v-shape around the v-shaped arrangement of the fluid ejection chambers.

11. The system of claim 7, wherein the dividers comprise a number of pillars formed in a v-shape around the v-shaped arrangement of the fluid ejection chambers.

12. A fluid ejection die comprising:

a number of fluid ejection chambers laid out to correlate with a number of dividers formed in a fluid channel layer;

wherein, across a width of the fluid ejection die, one side is a relatively higher-temperature side during operation and the opposite side is a relatively lower-temperature side; and wherein the fluid ejection chambers are arranged such that sequential fluid ejection chambers along a length of the die are alternatively arranged on the relatively higher-temperature side of the fluid ejection die and the relatively lower-temperature side of the fluid ejection die.

13. The fluid ejection die of claim 12, comprising:

a fluid ejection layer comprising:

a number of fluid ejection actuators disposed in the fluid ejection chambers; and a number of nozzles fluidically coupled to the fluid ejection chambers;

wherein the fluid channel layer defines a number of fluid channels therein, the fluid channels being fluidically coupled to the fluid ejection chambers via a number of fluid feed holes defined within the fluid ejection layer;

a fluid slot layer disposed on a side of the fluid channel layer opposite the fluid ejection layer, the fluid slot layer defining a first fluid slot and a second fluid slot.

14. The fluid ejection die of claim 12, wherein the fluid ejection chambers are arranged in a v-shape across a width of the fluid ejection die, and wherein the dividers comprise a number of ribs formed in a v-shape to correlate with the v-shaped arrangement of the fluid ejection chambers.

15. The fluid ejection die of claim 12, wherein the fluid ejection chambers are arranged in a v-shape across a width of the fluid ejection die, and wherein the dividers comprise a number of pillars formed in a v-shape to correlate with the v-shaped arrangement of the fluid ejection chambers.

16. The fluid ejection die of claim 1, wherein the fluid ejection chambers are arranged diagonally with respect to the width of the fluid ejection die.

17. The fluid ejection die of claim 1, further comprising dividers between adjacent lines of fluid ejection chambers.

18. The fluid ejection die of claim 1, wherein the fluid ejection chambers are arranged in parallel rows that are diagonal with respect to the width of the fluid ejection die, and further comprising a number of dividers being arranged diagonally with respect to the width of the fluid ejection die and in between adjacent rows of fluid ejection chambers.

19. The fluid ejection die of claim 12, wherein the fluid ejection chambers are arranged diagonally with respect to the width of the fluid ejection die.

20. The fluid ejection die of claim 16, wherein the fluid ejection chambers are arranged in parallel rows that are diagonal with respect to the width of the fluid ejection die, the number of dividers being arranged diagonally with respect to the width of the fluid ejection die and in between adjacent rows of fluid ejection chambers.

* * * * *